US005383418A

United States Patent [19]

Block et al.

[11] Patent Number: 5,383,418

[45] Date of Patent: Jan. 24, 1995

[54] TOP FEED SYSTEM WITH TOOTHED BELT AND CLUTCH

[75] Inventors: Charles Block, North Bellmore; Leon Mintz, Syosset, both of N.Y.

[73] Assignee: Joseph Galkin Corporation, Hicksville, N.Y.

[21] Appl. No.: 944,864

[22] Filed: Sep. 14, 1992

Related U.S. Application Data

[63] Continuation of Ser. No. 758,239, Sep. 10, 1991, Pat. No. 5,152,237, which is a continuation of Ser. No. 627,943, Dec. 13, 1990, abandoned, which is a continuation of Ser. No. 515,392, Apr. 27, 1990, abandoned, which is a continuation of Ser. No. 409,205, Sep. 19, 1989, abandoned, which is a continuation of Ser. No. 307,759, Feb. 7, 1989, abandoned, which is a continuation of Ser. No. 185,734, Apr. 25, 1988, abandoned, which is a continuation of Ser. No. 18,270, Apr. 24, 1987, abandoned, which is a continuation of Ser. No. 894,188, Aug. 7, 1986, abandoned, which is a continuation of Ser. No. 821,373, Jan. 22, 1986, abandoned, which is a continuation of Ser. No. 773,395, Sep. 6, 1985, abandoned, which is a continuation of Ser. No. 571,257, Jan. 16, 1984, abandoned.

[51] Int. Cl.[6] ..... D05B 27/04; D05B 29/06

[52] U.S. Cl. ..... 112/304; 112/320; 112/235

[58] Field of Search ..... 112/47, 60, 150, 235, 112/260, 303, 304, 318, 319, 320; 271/6, 7, 12, 34, 198, 266, 275; 198/725, 728, 861.5; 474/1, 2, 101, 102, 109, 113, 115

[56] References Cited

U.S. PATENT DOCUMENTS

| | | | |
|---|---|---|---|
| 573,327 | 12/1896 | Hanna | 112/260 |
| 2,241,230 | 5/1941 | Wilmoth | 112/304 |
| 3,087,446 | 4/1963 | Flach et al. | 112/304 |
| 3,783,990 | 1/1974 | Siciliano | 198/725 X |
| 3,835,716 | 9/1974 | Ballamy | 112/320 X |
| 4,171,129 | 10/1979 | Daley et al. | 271/6 |
| 4,311,106 | 1/1982 | Hannemann | 112/304 X |
| 4,417,535 | 11/1983 | Hannemann | 112/304 X |
| 4,594,957 | 6/1986 | Von Hagen | 112/304 |
| 5,022,336 | 6/1991 | Iwase | 112/304 |
| 5,152,237 | 10/1992 | Block et al. | 112/304 |

FOREIGN PATENT DOCUMENTS

| | | | |
|---|---|---|---|
| 0006487 | 1/1990 | European Pat. Off. | 112/304 |
| 3048012 | 7/1982 | Germany | 112/304 |
| 4522699 | 7/1970 | Japan | 112/304 |
| 3270084 | 11/1988 | Japan | 112/304 |

*Primary Examiner*—Clifford D. Crowder
*Assistant Examiner*—Ismael Izaguirre
*Attorney, Agent, or Firm*—Paul J. Sutton

[57] ABSTRACT

A synchronized, indexed positive material top feeding system for use with sewing and other applications. For example, material being fed to and through the sewing area of a sewing machine, is constantly "gripped" at the top thereof in front of, behind and in the sewing area as well as through an adjustable presser bar. This process takes place without affecting machine speeds, and in feeding movement that is synchronized with the machine feed dog for similar or variable stitch travel. This process is facilitated by a belt with "teeth" that contact and provide frictional engagement of the top of the material.

5 Claims, 4 Drawing Sheets 56
24
58
32
54
36
30
50
52
34
48
50
52
42
38
42
46
40
26
22
28
142
130
140
132
136

TOP FEED SYSTEM WITH TOOTHED BELT AND CLUTCH

This is a continuation of application Ser. No. 758,239, filed Sep. 10, 1991, and issued as U.S. Pat. No. 5,152,237 on Oct. 6, 1992, which in turn is a continuation of application Ser. No. 627,943 filed Dec. 13, 1990 and now abandoned. Ser. No. 627,943 is a continuation of application Ser. No. 515,392, filed Apr. 27, 1990 and now abandoned. Ser. No. 515,392 is a continuation of application Ser. No. 409,205, filed Sep. 19, 1989 and now abandoned. Ser. No. 409,205 is a continuation of Ser. No. 307,579, filed Feb. 7, 1989 and now abandoned. Ser. No. 307,579 is a continuation of Ser. No. 185,734, filed Apr. 25, 1988 and now abandoned. Ser. No. 185,734 is a continuation of Ser. No. 018,270, filed Apr. 24, 1987 and now abandoned. Ser. No. 018,270 is a continuation of Ser. No. 894,188, filed Aug. 7, 1986 and now abandoned. Ser. No. 894,188 is a continuation of Ser. No. 821,373, filed Jan. 22, 1986 and now abandoned. Ser. No. 821,373 is a continuation of Ser. No. 773,395, filed Sep. 6, 1985 and now abandoned. Ser. No. 773,395 is a continuation of Ser. No. 571,257, filed Jan. 16, 1984 and now abandoned.

BACKGROUND OF THE INVENTION

The present invention relates to the feeding of material through apparatus such as, but not limited to, sewing machines of the industrial variety, and more specifically to a novel positive top feed material handling system.

FIELD OF THE INVENTION

A need has long existed for an improved method and apparatus for feeding thicker and multilayered materials through the sewing area of industrial sewing machines. With the many variations in types and sewing speeds of such machines, prior efforts to meet this need has resulted in the development of many devices and mechanisms which include the use of feed rollers, compound feeds with a "walking" foot that moves together with the needle and feed dog, constant speed devices, top feed belts located along a side of the presser foot, belts located behind the presser foot (such as in the case of "pullers"), and a variety of types of feed dogs. All of these developments and efforts lack the features of the present invention needed to provide relatively fast, uncomplicated, reliable, efficient sewing without the drawbacks evident and visible in the finished product.

DESCRIPTION OF THE RELATED ART

Prior art patents known to the inventors include U.S. Pat. Nos. 182,158 to Boone; 365,956 to Wilson; 1,049,304 to Isherwood; 1,809,148 to Shrago; 3,310,014 to Tucci; 2,241,230 to Wilmoth; 3,213,814 to Boser; 4,311,106 to Hanneman; and 4,327,653 to Blessing. It is suggested that none of these patents teach, disclose, or suggest, either alone or in any combination with one another, the present invention as it will be more fully described hereinbelow.

SUMMARY OF THE INVENTION

It is an object of the present invention to provide a top feed system for use with sewing machines, or the like, which is reliable, easily serviced, possesses no critical parts which are subject to relatively heavy wear, and which provides a positive gripping and feeding of material entirely through the sewing area in synchronization with the movement of the machine's feed dog.

Another object of the present invention is to provide a top feed system, as above, which enables feeding pressure of multilayered work to be sewn in the needle area only, thereby allowing relatively free manipulation of this work.

Yet a further object is to provide such a top feed system wherein a presser bar is adjustable between settings that may include minimal or no pressure in the down position, thereby reducing or for that matter eliminating wear of the belt means described in detail below.

A further object of the present invention is to provide a top feed system, as above, which further includes an inverted belt or belt means having "teeth" of the timing belt type which contact the work being sewn in front of, through, and behind the sewing area of the machine. This belt is continuous or of infinite length and encircles the sewing area and machine in an open path which permits the dissipation or transfer to the environment of any heat in the belt which has been generated in the feeding area of its continuous path.

Another object is provide such a top feed system in which the belt is always in contact with the work while being stitched, thereby preventing undesirable shifting and slippage between the plies of multilayered fabric being sewn, and further preventing puckering or twisting that may affect the appearance of the finished work.

Yet a further object of this invention is to provide a top feed system, as above, which may be marketed as an attachment for use with an industrial sewing machine, or as an industrial sewing machine assembly which is equipped with these novel features, and which is both indexed for larger stitches and is synchronized with the motion of the feed dog to provide either the same or a different travel, this travel being variable in predetermined or preselected settings.

Yet a further object is to provide a top feed system, as above, wherein either a single or a plurality of needles in front, rear, or side arrangements facilitate multiple stitching capabilities.

These and other objects of the invention serve to overcome the drawbacks and disadvantages of prior art attempts to solve the aforementioned problems, and to meet the needs described. The following more detailed description of the apparatus is to be read in conjunction with the drawings in which similar reference characters are used throughout the several views, and in which:

DESCRIPTION OF THE PREFERRED EMBODIMENTS

Figure 1:
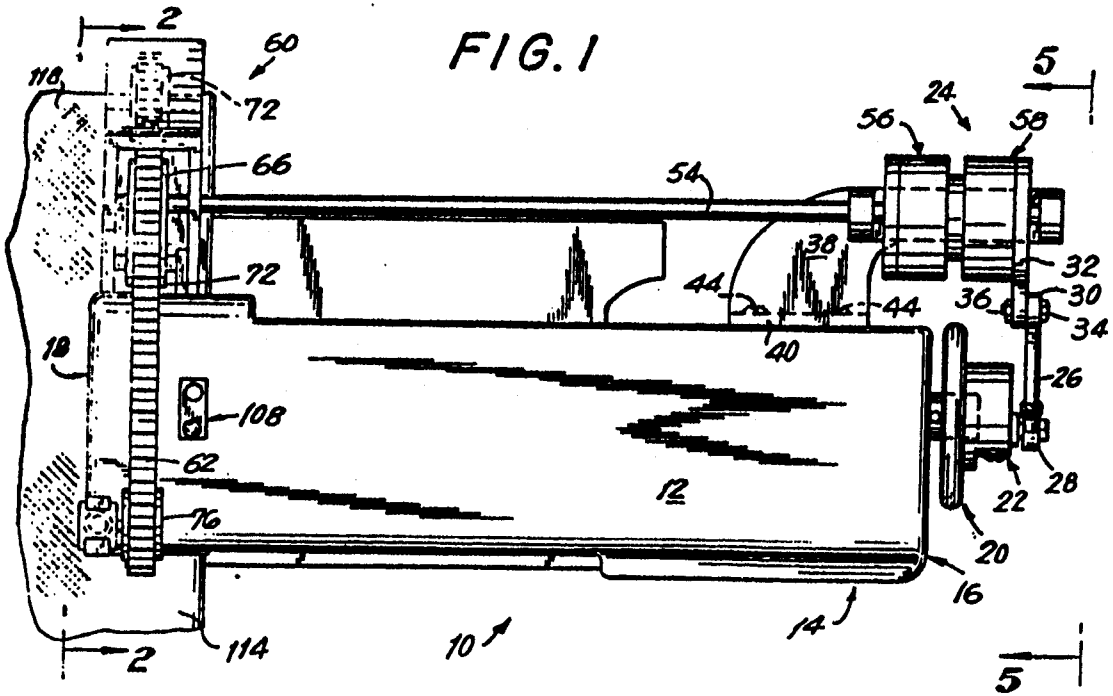
FIG. 1 is a top plan view of the one embodiment of the top feed material handling system according to the present invention.
Figure 2:
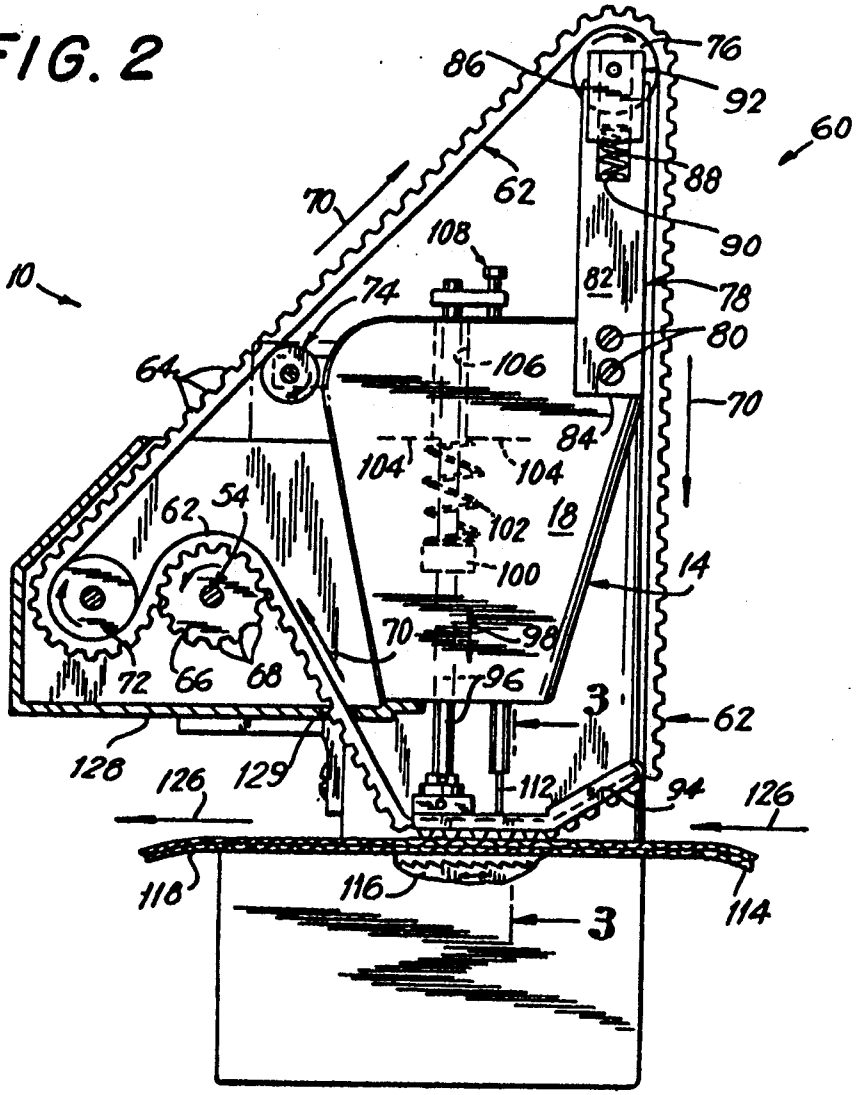
FIG. 2 is a side elevational view of the top feed system of FIG. 1 taken along line 2—2 of FIG. 1.

Referring now in more detail to the drawings, FIG. 1 in a top plan view of one embodiment of the present invention illustrates what will herein sometimes be referred to as either a material handling system or a top feed system 10, that may exist in either the form of a fully equipped sewing machine having all features of the present invention, or as an attachment to an industrial sewing machine. The arm 12 of such a sewing machine 14 is shown in FIGS. 1 and 2 extending from a machine drive end 16 to a sewing or free end 18.

A sewing machine handwheel 20 is illustrated in FIG. 1 at end 16 with an adjustable eccentric assembly 22 cooperatively interconnected to the drive means of sewing machine 12, assembly 22, in turn, being cooperatively interconnected to an anti-reverse clutch assembly 24 by means of connecting rod 26 which extends between a ball bearing end 28 and an opposite self-aligning rod end 30. End 30 is removably and adjustably fastened to a link plate 32 of clutch assembly 24 by means of a bolt 34 and nut 36 (best illustrated in FIG. 7).

Figure 7:
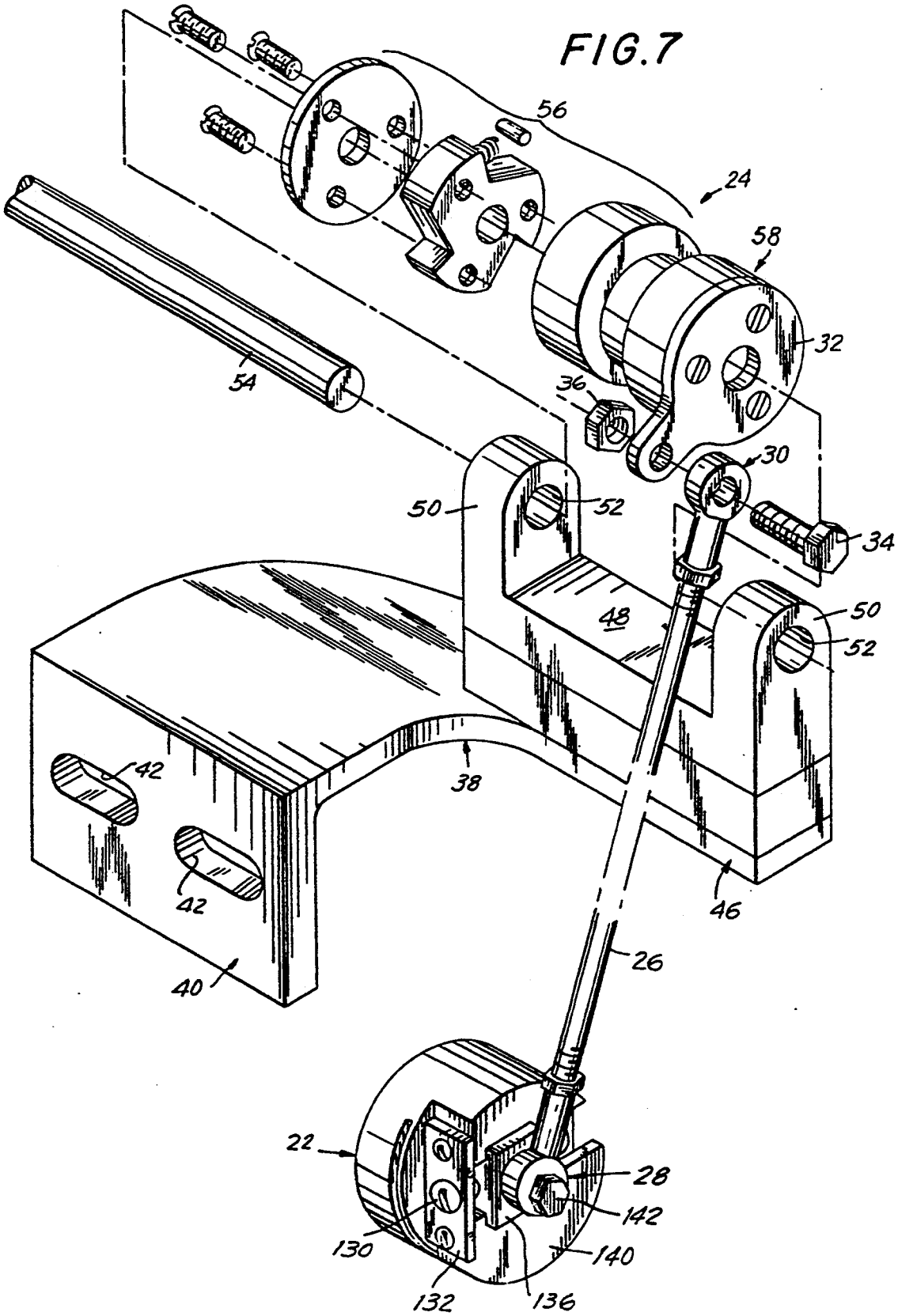
FIG. 7 is an exploded perspective view of an adjustable stroke ratcheting clutch assembly according to the present invention.

A bearing support bracket 38 shown in FIG. 7 includes a flange 40 formed with slotted bolt holes 42 at its inner end for relatively easy and efficient mounting to the rear side of arm 12 of sewing machine 14 by means of bolts 44 (FIG. 1). At its opposite end 46, a bearing module 48 is supported thereon with a pair of upstanding flanges 50 each formed with through holes 52 for removably receiving and holding anti-reverse clutch assembly 24 therebetween. An indexing feed drive shaft 54 is shown in FIGS. 1 and 7 extending through one of the holes 52 to an anti-reverse clutch subassembly 56 which forms part of the overall clutch assembly 24, its cooperative driving ratcheting clutch subassembly 58 being disposed adjacent it between the upstanding flanges 50 of the bearing module 48.

It should be stated here that the mechanisms described hereinabove, namely the anti-reverse and ratcheting clutch subassemblies 56 and 58, together with adjustable eccentric assembly 22 through connecting rod 26, cooperate to convert rotary motion delivered by the sewing machine drive to intermittent one-way rotary motion which is transferred to top feed indexing feed drive shaft 54, this intermittent motion being synchronized with that delivered to a machine feed dog described below. Thus, a top feed subassembly 60, by means of shaft 54, can be considered to be driven in response to the machine drive to perform the functions of the present invention.

Top feed subassembly 60 is shown in more detail with the aid of FIG. 2, which is a side elevational view of system 10 looking toward end 18 of sewing machine 14. A continuous belt 62, which may sometimes herein be referred to as a timing belt, is shown in FIG. 2 as including outwardly facing teeth 64 of a predetermined shape and configuration. Indexing top feed drive shaft 54 is also shown in FIG. 2 in mating interengagement with a driving timing belt sprocket wheel or pulley 66, formed with sprocket teeth 68 of desired shape and configuration able to matingly engage and drive toothed continuous timing belt 62 in the path and clockwise direction of the arrows 70 of FIG. 2.

The path of belt 62 after leaving driving sprocket wheel or pulley 66 includes an arcuate engagement at its inner untoothed surfaces with idler wheel 72, and thereupon upwardly at approximately 45 degrees such that the same inner untoothed surfaces engage idler guide roller 74, and thereafter to and into contact with an idler wheel 76 which forms the uppermost part of an adjustable belt tensioning assembly 78 mounted by means of fasteners 80 to end 18 of sewing machine arm 12. Belt tensioning assembly 78 to serves to adjustably control the tension in belt 62 and includes a bracket 82 through which fasteners 80 extend at its lower end 84, and an upper bracket end 86 at which idler wheel 76 is biased in an upward direction tending to expand the circumference of belt 62 by means of a helical compression spring 88. Spring 88 at its lower end exerts forces against a ledge 90 of bracket 82, while a wheel support bracket 92 is urged upwardly by the upper end of spring 88. It is to bracket 92 that idler wheel 76 is journalled. The relative disposition of bracket 82 with respect to machine end 18 will determine the forces exerted by idler wheel 76 of tensioning assembly 78 against timing belt 62. By moving bracket 82, the tensioning is adjustably controlled.

Before continuing with the description of the path of belt 62, it is desirable at this point in this specification to call the reader's attention to a presser foot 94 removably mounted to the bottom of a presser bar 96 which is movable upwardly and downwardly in the directions of arrows 98. A boss 100 integral with presser bar 96 forms a shoulder against which a lower end of a helical compression spring 102 is biased, while shoulders 104 adjacent opening 106 through which presser bar 96 extends define surfaces against which the upper end of spring 102 are biased. Spring 102 encircles and is thus held laterally by presser bar 96. Presser foot 94 is illustrated in a down position in FIG. 2, the down position of presser foot 94 being controllable by an adjustable stop assembly 108 located atop sewing machine arm 12.

Figure 3:
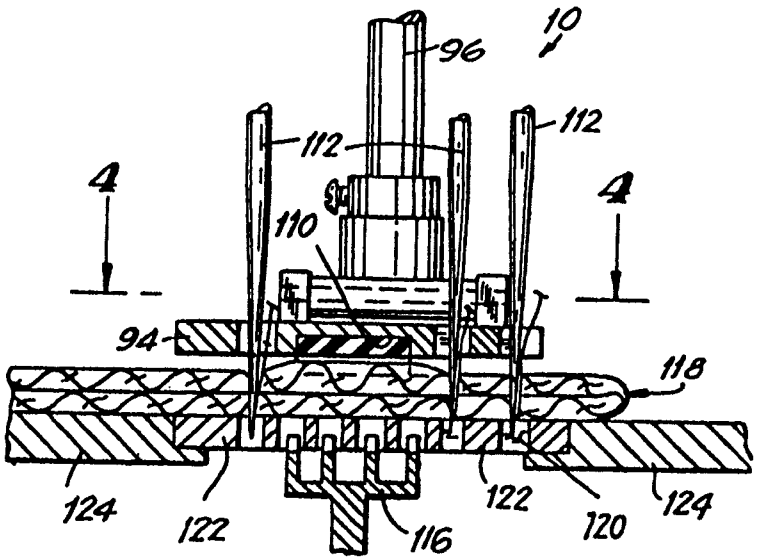
FIG. 3 is an enlarged partial fragmentary sectional elevational view taken along line 3—3 of FIG. 2.

Presser foot 94 is formed with a guide groove 110 of a width along its length sufficient to accept timing belt 62 therein. FIG. 3, in cross sectional view, best illustrates the disposition of belt 62 within groove 110 of presser foot 94. Holes through foot 94 accept sewing needles 112 therethrough, although it is contemplated with the present invention that either a single or a plurality of needles 112 extend downwardly from their respective needle bars in front, side or rear positions. While part of belt 62 is located within groove 110, the outwardly facing teeth 64 thereof extend beyond presser foot 94 into engagement with the uppermost layer of work 114 so as to provide the effect of an upper or top feed dog whose movements are synchronized with the movements of a machine feed dog designated 116 and illustrated within FIGS. 2 and 3.

This synchronization is achieved by the heretofore mentioned anti-reverse and ratcheting clutch assemblies 56 and 58 which cooperate with heretofore mentioned adjustable eccentric assembly 22 (adjusted to achieve synchronization of belt 62 with feed dog 116) to connect rotary motion delivered by the sewing machine drive to intermittent one-way rotary motion which is transferred to top feed indexing feed drive shaft 54. As stated heretofore, indexing top feed shaft 54 is in mating interengagement with a driving timing belt sprocket wheel or pulley 66, formed with sprocket teeth able to matingly engage and drive toothed continuous timing belt 62 in the path and clockwise direction of the arrows 70 of FIG. 2. Thus, it is clear that it is the adjustment of adjustable eccentric assembly 22 which ultimately synchronizes the movement of timing belt 62 with that of feed dog 116.

FIG. 3 illustrates a sewn product 118 which has resulted from the advancing of work 114 to and into engagement with belt 62 just before the sewing area (FIG. 2), the synchronized movements of feed dog 116 and belt 62 below and above the lowermost and uppermost layers, respectively, of work 114, the acting of sewing needles 112 through the work and thereafter through the clearance holes 120 in throat plate 122 lying flush with cloth plate 124, while presser foot 94 is in its downmost position with guided belt 62 engaging the work being fed in the direction of arrows 126 the entire length of presser foot 94.

Thus it is seen that belt 62, after leaving its contact with adjustable belt tension assembly 78 travels down to and into contact with the surfaces of presser foot 94 which define its groove 110 and work being fed to the sewing area, and finally back to driving wheel 66 integral with top feed indexing shaft 54 to complete its path cycle. Tension assembly 78 compensates for the downward movement of the presser bar and foot 96 and 94, respectively, maintaining desired tension in the belt 62. A material stripper 128 formed with an opening 129 fitted closely around the path of belt 62 prevents fouling of work or sewn product leaving the sewing area. The opening 129 permits the belt 62 to pass through material stripper 128. Any fabric or sewn product that adheres to the belt 62 will be separated from the belt 62 as it enters the opening which does not permit entry of anything other than the belt 62 alone. Had the fabric or sewn product been permitted to go beyond material stripper 128, it could foul the rest of the system which is not intended to receive anything other than the belt 62. From a comparison of the length of the belt 62 in the sewing area as compared to the length of belt 62 outside the sewing area it can be appreciated that more than ninety percent (90%) of the length of belt 62 is not in contact with the work 114, thereby facilitating the cooling transfer of heat from belt 62 to the environment about the belt 62 by connection.

Figure 4:
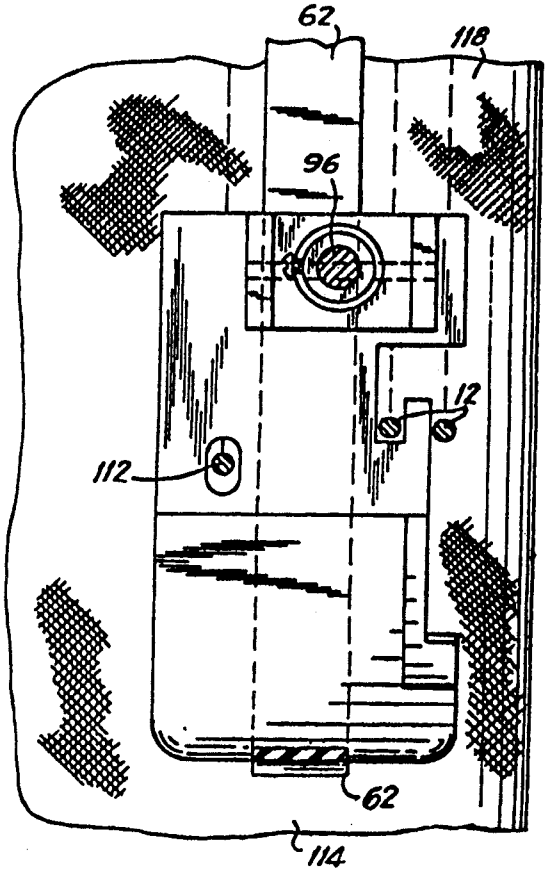
FIG. 4 is a partial fragmentary sectional plan view taken along line 4—4 of FIG. 3.
Figure 6:
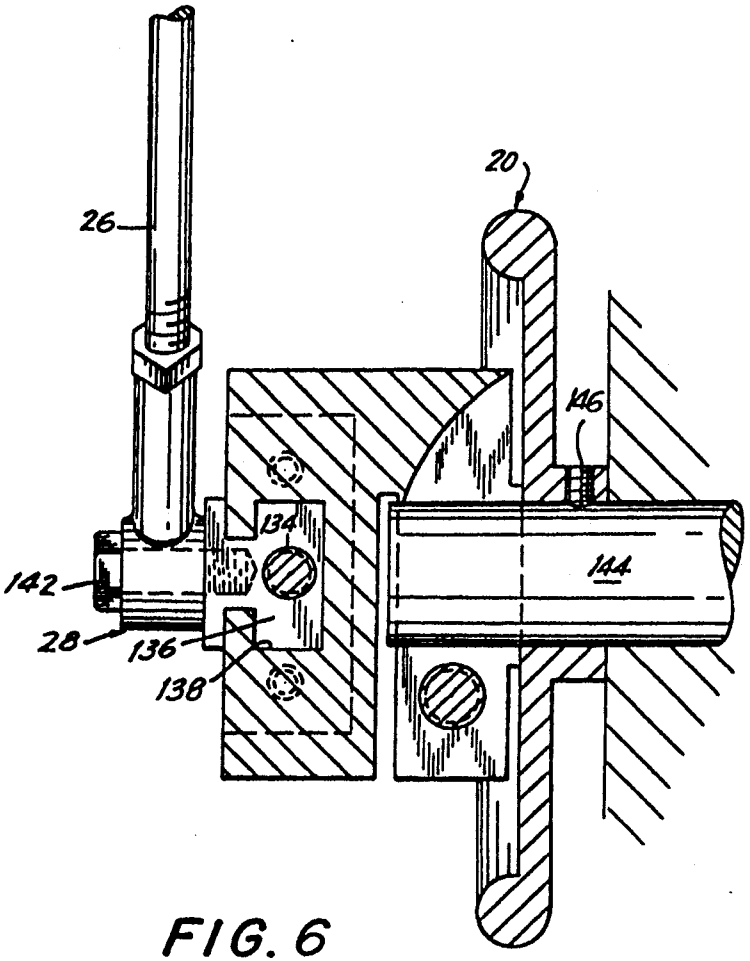
FIG. 6 is an enlarged partial fragmentary sectional elevational view taken along line 6—6 of FIG. 5.
Figure 5:
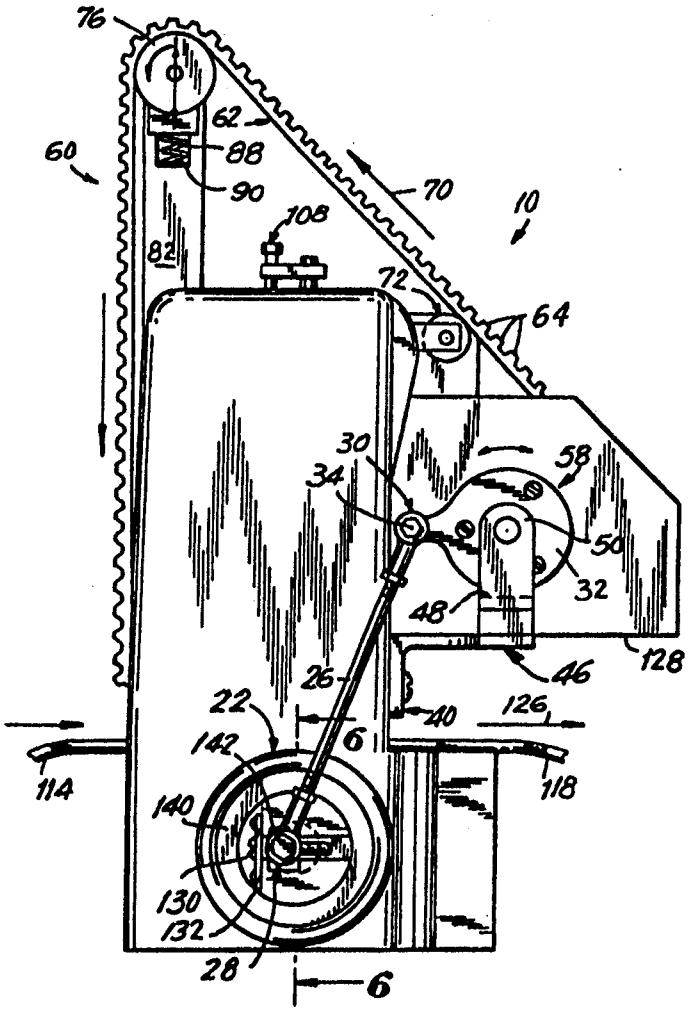
FIG. 5 is a side elevational view of the top feed system of FIG. 1 taken along line 5—5 of FIG. 1, looking at the opposite side of the machine with respect to FIG. 2.

FIGS. 4, 5 and 6 in enlarged and different views illustrate mechanical details of the present invention which accompany those already described above. For example, adjustable eccentric assembly 22 includes a slotted headed bolt 130 which extends through relatively thin capture plate 132 disposed such that the head of bolt 130 is captively held for rotary movement only, not axial movement. The threaded shank 134 of bolt 130 extends into mating or threaded engagement with threads of a T-shaped member 136 slidably disposed within an elongated slot 138 formed within collar 140. Rotary movement of bolt 130, such as by a screwdriver or other adjusting tool results in sliding movement of T-shaped member 136, thereby in turn affecting and adjusting the eccentric characteristics of the bottom of connecting rod 26. End 28 of connecting rod 26 is interconnected with T-shaped member 136 by means of a bolt 142. As best seen in FIG. 6, collar 140 of eccentric assembly 22 is removably held integral with machine drive shaft 144 to which handwheel 20 is held by means of set screw 146.

Since the specific inner makeup of anti-reverse clutch subassembly 56 and its multiple ramped inner ratchet, springs and rollers, per se, do not comprise the heart of this invention, more detail and attention thereto is not believed warranted.

Apart from what has already been described as objects and advantages of this invention, it should also now be obvious that belt 62 provides a constant gripping of work in the sewing area, and it automatically lifts with the lifting of the presser foot. The positive top feed provided by belt 62 is fully synchronized with movements of the original (feed dog) feed, and does not affect machine speeds.

The embodiments of the invention particularly described and disclosed are presented merely as examples of the invention. Other embodiments, forms and modifications of the invention coming within the proper scope and spirit of the appended claims will, of course, readily suggest themselves to those skilled in the art.

What is claimed is:

1. A material feeding system for cooperative use with a first feed means movably responsive to a first drive means, a sewing area including and immediately adjacent at least one sewing needle wherein sewing is accomplished, the improvement comprising, in combination:

a cloth plate having a working surface plane over which an advancing fabric travels, a continuous belt formed with a plurality of spaced toothed portions which include gripping surfaces and which are on a side facing toward said working surface plane, and belt drive means responsive to said first drive means for moving said belt along a path, a throat plate situated adjacent to said cloth plate having at least one hole therein through which said at least one needle passes after passing through said fabric work piece, a machine drive means, said belt drive means including clutch means for converting input motion from said first drive means to substantially intermittent rotational output motion of a shaft member in a single rotational drive direction said machine drive means including adjustment means to vary in a predetermined manner said output motion to be substantially synchronized with respect to the motion of said first feed means, said continuous belt in cooperation with said first feed means comprising second feed means for reliably gripping and advancing upper and lower surfaces of a fabric work piece into, through and out of said sewing area; and a material stripper having an opening fitted closely around said path of said feed drive means in a location to prevent fouling of said fabric work piece after it leaves said presser means, cloth plate, and throat plate to permit a cooling transfer of any beat that builds up in said belt as a result of the travel of said belt and said fabric work piece through said dewing area, by convection from said belt to the environment about said belt after it leaves the region of said presser means said cloth plate and throat plate.

2. A sewing machine assembly comprising, in combination:

a machine drive means, a sewing area including and immediately adjacent at least one sewing needle wherein sewing is accomplished, a cloth plate having a working surface plane over which a fabric work piece travels, feed dog means responsive to said machine drive means and movable beneath and above the working surface plane of said cloth plate for contacting the underside of said fabric work piece, presser means having an upper surface and a lower surface and a fixed length, a guide groove in said lower surface along its entire length, said guide groove defined by two parallel, spaced apart side walls bridged by a top wall said presser means responsive to said machine drive means to move between relatively distant and proximate positions with respect to said cloth plate plane, a continuous belt formed with a plurality of spaced toothed portions which include gripping surfaces and which are on a side facing toward said working surface plane, said belt having a top surface spaced apart from said gripping surfaces and two side surfaces between said top surface and said gripping surfaces, and belt drive means responsive to said machine drive means for moving said belt along a path, said path including a portion thereof between said presser means and said cloth plate, said belt being substantially surrounded on its top and two side surfaces by said top and two side walls of said guide groove as said belt traverses the length of said presser means;

a throat plate situated adjacent to said cloth plate and having a top surface substantially parallel to said working surface plane along said path, said throat plate having at least one hole therein through which said at least one sewing needle passes after passing through said fabric work piece, said feed drive means including clutch means for converting an input motion from said machine drive means to a substantially intermittent rotational output motion by a shaft member in a single rotational drive direction, said machine drive means including adjustment means to vary in a predetermined manner said output motion of said shaft to be substantially synchronized with respect to the motion of said feed dog means, and thus to variably affect the length of stitches sewn by said machine; and a material stripper having an opening fitted closely around said path of said feed drive means in a location to prevent fouling of said fabric work piece after it leaves said presser means, cloth plate, and throat plate to permit a cooling transfer of any beat that builds up in said belt as a result of the travel of said belt and said fabric work piece through said sewing area by convection from said belt to the environment about said belt after it leaves the region of said presser means, cloth plate and throat plate.

3. A material feeding system for use with a sewing machine which comprises a machine drive means, a presser means having an upper surface and a lower surface and a fixed length, said presser means having a guide groove in its lower surface along its entire length, said groove defined by two parallel, spaced apart side walls bridged by a top wall, a sewing area including and immediately adjacent at least one sewing needle wherein sewing is accomplished, a cloth plate having a working surface plane over which an advancing fabric work piece travels, feed dog means responsive to said machine drive means and movable beneath and above said working surface plane of said cloth plate for contacting the underside of said fabric work piece and said presser means between relatively distant and proximate positions with respect to said cloth plate plane, the improvement comprising in combination:

a continuous belt formed with a plurality of spaced tooth portions which include gripping surfaces and which are on a side facing toward said working surface plane, said belt having a top surface spaced apart from said gripping surfaces and two side surfaces between said top surface and said gripping surfaces, and belt drive means responsive to said machine drive means for moving said belt along a path, said path including a portion thereof between said presser means and said cloth plate, said belt being substantially surrounded on its top and two side surfaces by the walls defining said guide groove as said belt traverses said presser means guide groove;

a throat plate situated adjacent to said cloth plate and having a top surface substantially parallel to said working surface plane along said path, said throat plate having at least one hole therein through which said at least one sewing needle passes after passing through said fabric work piece, said belt drive means including clutch means for converting an input motion from said machine drive means to a substantially intermittent rotational output motion by a shaft member in a single rotational drive direction, said machine drive means including adjustment means to vary in a predetermined manner said output motion of said shaft member to be thus substantially synchronized with respect to the motion of said feed dog means, and to thus variably affect the length of stitches sewn by said machine, said continuous belt in cooperation with said feed dog means comprising feed means for reliably gripping and advancing a fabric work piece substantially synchronized with respect to the motion of said feed dog means, and a material stripper having an opening fitting closely around said path of said feed drive means in a location to prevent fouling said fabric work piece after it leaves said presser means, cloth plate, and throat plate to permit a cooling transfer of any beat that builds up in said belt as a result of the travel of said belt and said fabric work piece through said sewing area by convection from said belt to the environment about said belt after it leaves the region of said presser means, cloth plate and throat plate.

4. A system according to claim 3, further including means for influencing tension in said continuous belt, wherein said means for influencing tension in said continuous belt comprises a movable bracket attachable to said sewing machine, a compression spring at one end contacting a ledge of said movable bracket, an idler wheel mounted on an upper end of said movable bracket and journaled on a wheel support bracket, said spring contacting said wheel support bracket to cause said idler wheel to impinge upon said belt.

5. A system according to claim 1, further including means for influencing tension in said continuous belt, wherein said means for influencing tension in said continuous belt comprises a movable bracket attachable to said sewing machine, a compression spring at one end contacting a ledge of said movable bracket, an idler wheel mounted on an upper end of said movable bracket and journaled on a wheel support bracket, said spring contacting said wheel support bracket to cause said idler wheel to impinger upon said belt.

* * * * *